US006324728B1

(12) United States Patent
Blankenheim

(10) Patent No.: US 6,324,728 B1
(45) Date of Patent: Dec. 4, 2001

(54) ERGONOMIC ATTACHMENT FOR INLINE POWER TOOLS

(75) Inventor: Eric C. Blankenheim, Appleton, WI (US)

(73) Assignee: Blankenheim Services, LLC, Appleton, WI (US)

( * ) Notice: Subject to any disclaimer, the term of this patent is extended or adjusted under 35 U.S.C. 154(b) by 0 days.

(21) Appl. No.: 09/419,650

(22) Filed: Oct. 18, 1999

(51) Int. Cl.[7] ..... E05B 7/00
(52) U.S. Cl. ..... 16/431; 16/430; 16/110.1
(58) Field of Search ..... 16/DIG. 12, DIG. 19, 16/430, 431; 294/25, 26, 19.1, 57, 58; 15/143.1, 236.01, 236.02

(56) References Cited

U.S. PATENT DOCUMENTS

| | | | | |
|---|---|---|---|---|
| 3,624,044 | * | 11/1971 | Wu | 260/77.5 |
| 4,962,561 | * | 10/1990 | Hamilton | 15/111 |
| 5,125,130 | | 6/1992 | Stanish | 16/110 R |
| 5,156,429 | * | 10/1992 | Adams | 294/25 |
| 5,455,981 | * | 10/1995 | Wiese | 15/236.01 |
| 5,544,554 | | 8/1996 | Brightly | 81/57.4 |
| 5,588,903 | | 12/1996 | Pennison | 451/344 |
| 5,716,087 | | 2/1998 | Backish et al. | 294/55 |

OTHER PUBLICATIONS

Human Factors Society, 1988, pp 61–69; "Evaluation of Powered Screwdriver Design Characteristics".
D–G Industries brochure; "DGI Ergonomic Power Tool Accessories".

* cited by examiner

*Primary Examiner*—Anthony Knight
*Assistant Examiner*—Ruth C. Rodriguez
(74) *Attorney, Agent, or Firm*—William K. Baxter; Godfrey & Kahn, S.C.

(57) ABSTRACT

An ergonomic attachment for inline power tools reduces the forces, stresses, and tensions experienced by operators of inline power tools. The ergonomic attachment includes a removable attachment mechanism, which attaches to the base of the inline power tool. The attachment mechanism includes a bracket and a U-shaped member, which extends around the base of the inline power tool and is fastened to the bracket by fasteners to secure the attachment device to the inline power tool. Pivotally attached to the attachment mechanism is a padded ergonomic support member. The ergonomic support member includes an elongated horizontal portion and an inverted U-shaped portion. The attachment is spring loaded with a helical spring connected between the attachment mechanism and the support member. The spring forces the inverted U-shaped portion downwardly against the top of an operator's forearm.

18 Claims, 3 Drawing Sheets

ERGONOMIC ATTACHMENT FOR INLINE POWER TOOLS

BACKGROUND OF THE INVENTION

The present invention relates to attachments for power tools, and more particularly to an ergonomic attachment for inline power tools which reduces stress related injuries to the hand, wrist, and forearm of inline power tool operators.

Inline power tools, such as pneumatic and electric nut drivers are commonly used in many industries, especially in electronic assembly areas. These tools are used for tightening fasteners, such as screws, bolts, nuts, and the like. Most industrial applications require some form of radial or ulnar wrist deviation. The power tools produce an extensive amount of torque and vibration, which is transmitted to the operator's hands and wrists. Prolonged usage of these tools has been known to cause cumulative trauma and repetitive stress injuries, such as carpal tunnel syndrome and tenosynovitis to the hands, wrists, and forearms of workers who use the tools on a daily basis.

Cumulative trauma injuries to the hand, wrist, and forearm are the result of prolonged and repetitive exposure to damaging stress. Prolonged and repetitive use of inline power tools frequently causes fatigue, strain, pain, and injury to an operator's hand, wrist, and forearm. Accordingly improvements have been proposed to more naturally orient the user's extremities and/or distribute the forces associated with operating these types of power tools.

There have been a number of patents issued relating to ergonomic attachments for powered hand tools. For example, U.S. Pat. No. 5,544,554 discloses an ergonomic torque wrench mounting apparatus in which a pneumatic torque wrench is mounted on a torque arm or cantilevered support attached to a rigid surface, such as a workbench. While this apparatus does effectively eliminate torque exposed to the operator, it is very large, cumbersome, and expensive to implement. In addition, the operator must still apply a downward force to tighten the fastener, which may harm the hand and wrist. Most torque arm apparatus take up a lot of room on the workbench, and are limited with respect to the position and angle with which the tool can be used.

At least one manufacturer, D-G Industries of Brea, Calif. has introduced an ergonomic power tool attachment marketed under the trademark Bio-Brace™. This device includes an attachment mechanism, which slides over the body of the tool and is clamped in place by a clamping screw. A U-shaped support mechanism rigidly attached to the attachment mechanism cradles the underside of the wrist and forearm of an operator to absorb the torque and vibration associated with operating the power tool.

The Bio-Brace™ device appears to be relatively heavy, and being under the forearm, adds to the weight of the tool. The device may also add to the resisted ulnar deviation of the wrist when holding the tool. The Bio-Brace™ attaches to the power tool using a specialized donut-type attachment mechanism, which is not universal. In other words, users are required to obtain a new specific donut-type attachment for different sized tools. This adds to the expense of the device and significantly decreases its versatility.

Therefore, there is a need to provide an ergonomic attachment for inline power tools that is easier to implement, less cumbersome, and less expensive than prior art devices.

SUMMARY OF THE INVENTION

The present invention is an ergonomic attachment for inline power tools. The attachment is designed to reduce the forces, stresses, and tensions experienced by operators of inline power tools, by damping and transferring the forces to the forearm of an operator. The ergonomic attachment includes a universal, removable attachment mechanism, which attaches to the base of an inline power tool. The attachment mechanism includes a bracket and a U-shaped member, which extends around the base of the inline power tool and fastens to the bracket by fasteners. Pivotally attached to the attachment mechanism is a padded ergonomic support member. The ergonomic support member includes an elongated horizontal portion and an inverted U-shaped portion. The elongated horizontal portion extends substantially parallel to the operator's forearm when in use. The inverted U-shaped portion extends around the top surface of the operator's forearm. The attachment is spring loaded with a helical spring connected between the attachment mechanism and the support member. The spring forces the inverted U-shaped portion of the support member downwardly against the top of an operator's forearm.

It is an object of the present invention to reduce repetitive stress injuries to operators of automatic assembly power tools. The present invention transfers stress to a user's forearm to redistribute the load from the hand and wrist to the more robust and fatigue resistant structures of the forearm.

The attachment device is designed to reduce stress-related trauma associated with prolonged use of these types of power tools. The device addresses force distribution, primarily force imposed on the tool being redistributed to the user's forearm. The device also allows the user to orient his or her own extremities. The horizontal member is substantially parallel to the longitudinal axis of the user's forearm when in use.

Inline power tools continue to be ubiquitous in manufacturing processes and despite research, continue to present significant ergonomic hazards, including high torque, upper extremity vibration, awkward postures associated with frequency and torque. The device of the present invention is designed to reduce the torque and vibration exerted on the wrist by using the forearm to absorb the torque and vibration.

The device effectively eliminates torque at the hand machine interface and reduces the subsequent force at the forearm to approximately 10% of the tool rated torque. Consequently, if a specific tool were required to exert 50" pounds torque, the force to the forearm would be between five and seven pounds, well within acceptable levels. It provides a very lightweight alternative, using aluminum parts. It decreases the resisted ulnar deviation force by holding the tool by the spring pressure, which translates some of the force of the tool to the radial forearm. And it allows the worker to operate the tool in any position, including full forearm supination or pronation, full wrist radial deviation or ulnar deviation, full wrist flexion or extension. In addition, the attachment dampens vibrations by decreasing the force couple of the hand and the tool interface, and decreases the peak torque reaction by increasing the angular inertia of the tool. The universal attachment using wing nut technology makes it relatively easy to put on a specific tool and remove it if there is a specific tool used for an application.

Preliminary test data shows an approximate 50% decrease in peak EMG (electromyography) readings of the wrist flexor and extensor muscles of operators using the attachment device.

Various other features, objects, and advantages of the invention will be made apparent to those skilled in the art from the following drawings and detailed description of the invention.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
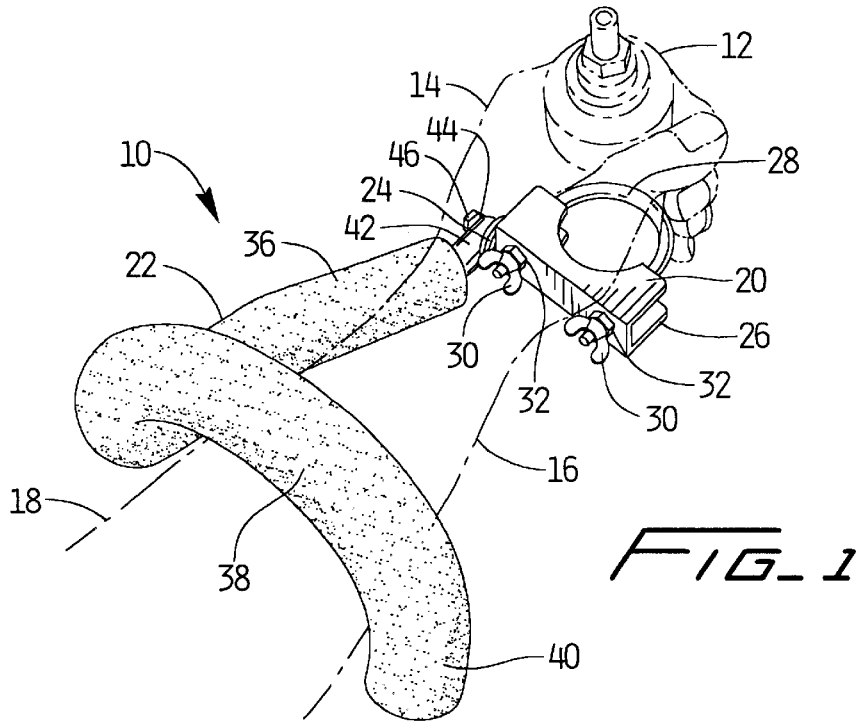
FIG. 1 is a perspective view of an ergonomic attachment device attached to an inline power tool in accordance with the present invention.
Figure 2:
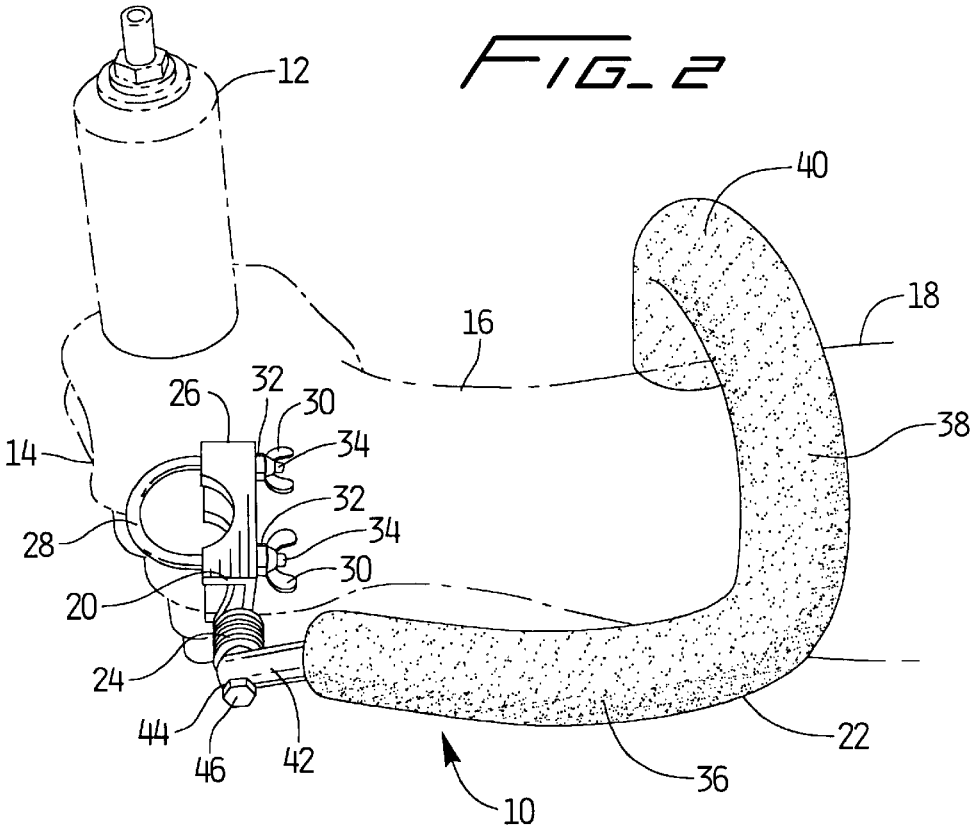
FIG. 2 is another perspective view of the ergonomic attachment device of FIG. 1.

Referring now to FIGS. 1 and 2, an ergonomic attachment device 10 is shown attached to an inline power tool 12, and being used by an operator. The hand 14 of the operator grasps the cylindrically shaped inline power tool 12 as shown in FIG. 1, while an elongated, inverted U-shaped support member 22 wraps around the upper forearm 18 of the operator. The attachment device 10 reduces the forces, stress and tension on the wrist 16 of an operator, and allows for a more natural position of the wrist 16 and hand 14. The force and weight of the power tool 12 is transferred from the hand 14 and wrist 16 to the forearm 18 which is better suited to accept the stress and tension associated with operating the power tool 12.

The ergonomic attachment device 10 includes an attachment mechanism 20 which attaches to the base of the inline power tool 12, and an elongated, inverted U-shaped support member 22 pivotally attached to one side of the attachment mechanism 20. The attachment device 10 is spring-loaded with a helical spring 24 attached between the attachment mechanism 20 and the support member 22. The spring 24 forces the support member 22 downwardly against the upper forearm 18 of an operator.

The attachment mechanism 20 of the device 10 includes a bracket 26 and a removable U-shaped member 28 which extends around the base of the inline power tool 12 and is fastened to the bracket 26 with fasteners 30 to secure the attachment device 10 to the inline power tool 12. The U-shaped member 28 includes two ends 34 that are preferably threaded to accept threaded fasteners 30. The attachment device 10 is removably attached to the tool 12 by placing the bracket 26 against the base of the tool 12, and fastening the U-shaped member 28 around the base by inserting the ends 34 of the U-shaped member 28 through openings 32 in a vertical portion 54 of the bracket 26. The U-shaped member 28 is held in place by the fasteners 30. The fasteners 30, preferably wing nuts, are attached to the threaded ends 34 of the U-shaped member 28. The U-shaped member 28 may be removably fastened to the bracket 26 by other means, such as a tongue and groove attachment or other clamping mechanism. The attachment mechanism 20 is adjustable so that it may be installed on a wide variety of power tools of different sizes and shapes.

The ergonomic support member 22 includes an elongated horizontal portion 36 and an inverted U-shaped portion 38. The elongated horizontal portion 36 and the inverted U-shaped portion 38 are preferably made from a strong lightweight material, such as plastic or aluminum, and covered with a soft padding 40, preferably made of urethane or other similar soft material. The elongated horizontal portion 36 and the inverted U-shaped portion 38 are preferably integral with one another as a single piece of lightweight material. The elongated horizontal portion 36 includes one end 42 extending outwardly from the padding 40 for attachment to the attachment mechanism 20. The one end 42 of the elongated horizontal portion 42 extending outwardly from the padding 40 has an opening 44 extending therethrough for receiving a pin or bolt 46 to pivotally attach the support member 22 to the attachment mechanism 20, as shown in FIG. 3.

Figure 3:
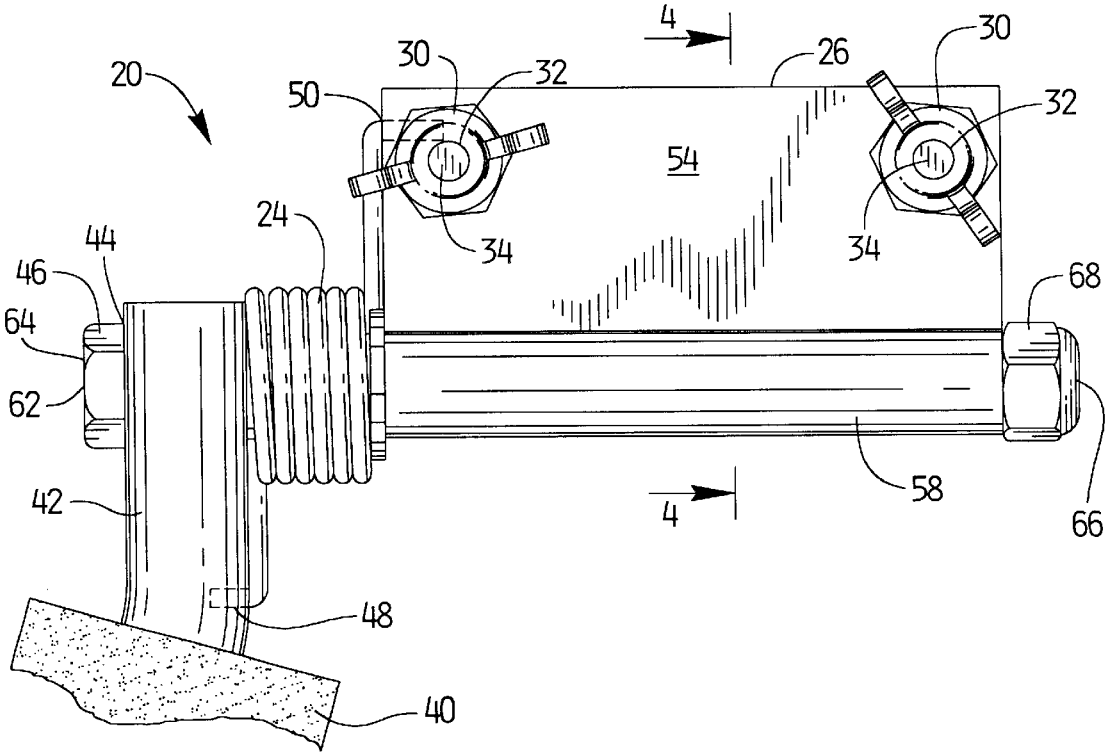
FIG. 3 is an enlarged top plan view of the attachment portion of the ergonomic attachment device of FIG. 1.

FIG. 3 illustrates the spring-loaded attachment mechanism 20 of the support member 22 in a first embodiment of the invention. One end 48 of the spring 24 is attached to the one end 42 of the elongated horizontal portion 36, while the other end 50 of the spring 24 is attached to the bracket 26 or the U-shaped member 28 of the attachment mechanism 20 The spring 24 forces the inverted U-shaped portion 38 downwardly against the top of an operator's forearm 18.

Figure 4:
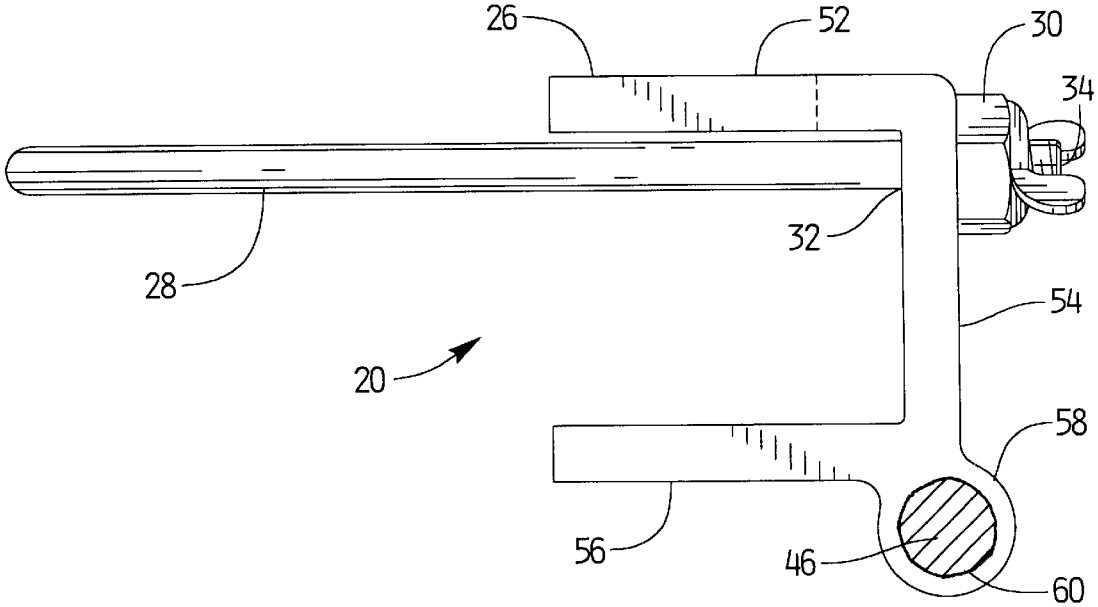
FIG. 4 is an enlarged cross-sectional view of the attachment portion of the ergonomic attachment device taken along line 4—4 of FIG. 3.

Referring to FIG. 4, the bracket 26 is preferably C-shaped with an upper horizontal member 52, a vertical member 54, and a lower horizontal member 56. The bracket 26 further includes a hollow cylindrical member 58 attached to one end of the bracket 26 for receiving the pin 46 for rotationally mounting the support member 22 to the attachment mechanism 20. The cylindrical member 58 is preferably welded to one end of the bracket 26, but may be integral thereto, or fixedly attached to the bracket 26 by other means. The pin 46 extends through the opening 44 in the one end 42 of the elongated horizontal portion 36 of the support member 22, and through the hollow opening 60 in the cylindrical member 58 attached to the bracket 26. As shown in FIG. 3, the pin 46 has a first end 64 with a head 62, and a second end 66 for receiving a fastening device 68. The fastening device 68 holds the pin 46 within the hollow opening 60 of the cylindrical member 58. The pin 46 freely rotates within the hollow opening 60, and allows the support member 22 to rotate around the attachment mechanism 20.

Figure 5:
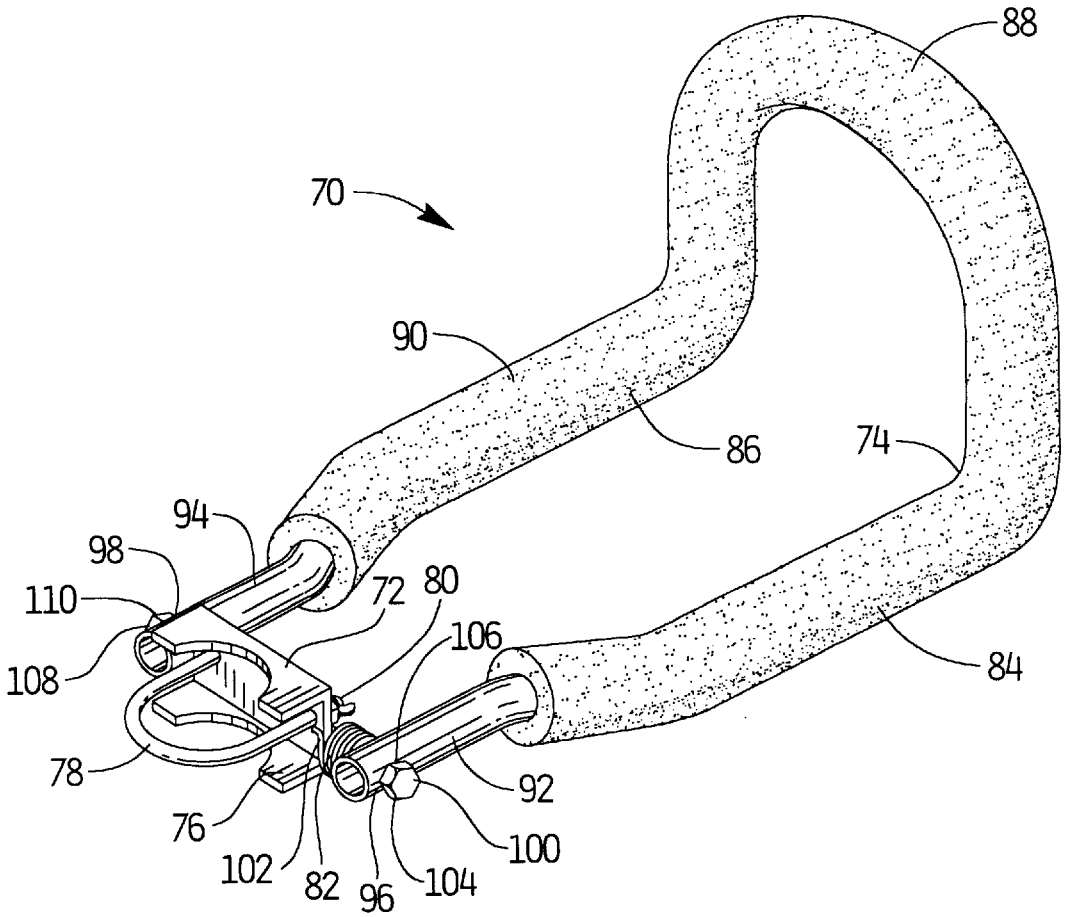
FIG. 5 is a perspective view of an alternative embodiment of an ergonomic attachment device.

Referring next to FIG. 5, in an alternative embodiment of the invention, an ergonomic attachment device 70 includes an attachment mechanism 72, which removably attaches around the base of an inline power tool, and an ergonomic support member 74. The attachment mechanism 72 includes a bracket 76 and a U-shaped member 78 which extends around the base of the inline power tool and is fastened to the bracket 76 by a pair of fastening devices 80 to secure the attachment device 70 to the inline power tool.

The ergonomic support member 74 includes a first elongated horizontal portion 84, an inverted U-shaped portion 88, and a second elongated horizontal portion 86. The support member 74 fits around and rests upon the forearm of an inline power tool operator. The first and second elongated horizontal portions 84, 86 and the inverted U-shaped portion 88 are preferably integral with one another and made from a strong lightweight material, such as plastic or aluminum, and covered with a soft padding 90, preferably made of urethane or other similar soft material. The first and second elongated horizontal portions 84, 86 include uncovered ends 92, 94 extending outwardly from the padding 90 for attachment to the attachment mechanism 72. The ends 92, 94 of the first and second elongated horizontal portions 84, 86 extending outwardly from the padding 90 have holes 96, 98 extending therethrough for receiving a pin or bolt 100 to pivotally attach the support member 74 to the attachment mechanism 72.

The attachment device 70 is spring-loaded with a helical spring 82 connected between the attachment mechanism 72 and the support member 74. The spring 82 forces the inverted U-shaped portion 88 downwardly against the top of an operator's forearm.

The bracket 76 further includes a hollow cylindrical member 102 for receiving the pin 100 rotationally mounting the support member 74 to the attachment mechanism 72. The cylindrical member 102 is preferably welded to one end of the bracket 76, but may be integral thereto, or fixedly attached to the bracket 76 by other means. The pin 100 extends through the holes 96, 98 in the ends 92, 94 of the first and second elongated horizontal portions 84, 86 of the support member 74, and through the hollow cylindrical member 102 attached to the bracket 76. The pin 100 having a first end 106 with a head 104, and a second end 108 for receiving a fastening device 110 to hold the pin 100 within the hollow cylindrical member 102. The pin 100 freely rotates within the cylindrical member 102, and allows the support member 74 to rotate around the attachment mechanism 72.

While the invention has been described with reference to preferred embodiments, those skilled in the art will appreciate that certain substitutions, alterations and omissions may be made without departing from the spirit of the invention. Accordingly, the foregoing description is meant to be exemplary only, and should not limit the scope of the invention set forth in the following claims.

I claim:

1. An ergonomic attachment for an inline power tool comprising:

an attachment mechanism for attaching the ergonomic attachment to the inline power tool;

a support member attached to the attachment mechanism for providing support to the hand, wrist and forearm of an operator;

wherein the support member includes an elongated horizontal portion and an inverted U-shaped portion; and wherein the inverted U-shaped portion rests on the operator's radial forearm when in use.

2. The ergonomic attachment of claim 1 wherein the attachment mechanism is removable and adaptable to be attached to a wide variety of power tools.

3. The ergonomic attachment of claim 1 wherein the attachment mechanism and support member are made of a strong lightweight material.

4. The ergonomic attachment of claim 1 wherein the support member further includes padding covering the elongated horizontal portion and the inverted U-shaped portion.

5. The ergonomic attachment of claim 1 wherein the support member is fixedly attached to the attachment mechanism.

6. An ergonomic attachment for an inline power tool comprising:

an attachment mechanism for attaching the ergonomic attachment to the inline power tool;

a support member attached to the attachment mechanism for providing support to the hand, wrist and forearm of an operator; and wherein the attachment mechanism includes a bracket and a removable U-shaped member attached to the bracket with fasteners.

7. An ergonomic attachment for an inline power tool comprising:

an attachment mechanism for attaching the ergonomic attachment to the inline power tool;

a support member attached to the attachment mechanism for providing support to the hand, wrist and forearm of an operator;

wherein the attachment mechanism includes a bracket and a removable U-shaped member attached to the bracket with fasteners; and wherein the fasteners are wing nuts screwed on to threaded ends of the U-shaped member.

8. An ergonomic attachment for an inline power tool comprising:

an attachment mechanism for attaching the ergonomic attachment to the inline power tool;

a support member attached to the attachment mechanism for providing support to the hand, wrist and forearm of an operator;

wherein the support member includes an elongated horizontal portion and a removeable inverted U-shaped portion;

wherein the support member further includes padding covering the elongated horizontal portion and the inverted U-shaped portion; and wherein the padding is made of a soft lightweight material.

9. An ergonomic attachment for an inline power tool comprising:

an attachment mechanism for attaching the ergonomic attachment to the inline power tool;

a support member attached to the attachment mechanism for providing support to the hand, wrist and forearm of an operator;

wherein the support member includes an elongated horizontal portion and an inverted U-shaped portion wherein the inverted U-shaped portion rests on the operator's radial forearm when in use; and wherein the elongated horizontal portion is substantially parallel to the operator's forearm when in use.

10. An ergonomic attachment for an inline power tool comprising:

an attachment mechanism for attaching the ergonomic attachment to the inline power tool;

a support member attached to the attachment mechanism for providing support to the hand, wrist and forearm of an operator; and wherein the support member is spring-loaded and pivotally attached to the attachment mechanism with a spring.

11. An ergonomic attachment for an inline power tool comprising:

an attachment mechanism for attaching the ergonomic attachment to the inline power tool;

a support member attached to the attachment mechanism for providing support to the hand, wrist and forearm of an operator; and wherein the spring is a helical spring having a first end attached to one end of the attachment mechanism and a second end attached to one end of the support member.

12. An ergonomic attachment for an inline power tool comprising:

an attachment mechanism for attaching the ergonomic attachment to the inline power tool;

a support mechanism rotationally attached to the attachment mechanism for providing support to the hand, wrist and forearm of an operator; and wherein the support member is spring-loaded with a spring connected between the attachment mechanism and the support member.

13. The ergonomic attachment of claim 12 wherein the attachment mechanism includes a bracket and a removable U-shaped member fastened to the bracket with fasteners.

14. The ergonomic attachment of claim 12 wherein the attachment mechanism is removable and adaptable to be attached to a wide variety of power tools.

15. The ergonomic attachment of claim 12 wherein the attachment mechanism and the support member are made of a strong lightweight material.

16. The ergonomic attachment of claim 12 wherein the support member includes an elongated horizontal portion and an inverted U-shaped portion.

17. An ergonomic attachment for an inline power tool comprising:

an attachment mechanism for attaching the ergonomic attachment to the inline power tool;

a support mechanism rotationally attached to the attachment mechanism for providing support to the hand, wrist and forearm of an operator;

wherein the support member is spring-loaded with a spring connected between the attachment mechanism and the support member;

wherein the support member includes an elongated horizontal portion and an inverted U-shaped portion; and wherein the support member further includes padding covering the elongated horizontal portion and the inverted U-shaped portion.

18. An ergonomic attachment for an inline power tool which extends the effective lever arm of the tool to the forearm, comprising:

a removable attachment mechanism for attaching the ergonomic attachment to the inline power tool;

wherein the attachment mechanism includes a bracket and a U-shaped member for removably attaching the attachment mechanism around the inline power tool;

a support member pivotally attached to the attachment mechanism for providing support to the hand, wrist and forearm of an operator; and wherein the support member includes a padded elongated horizontal portion and a padded inverted U-shaped portion, the support member being spring loaded, with a helical spring attached between the attachment mechanism and the support member.

* * * * *